US007883361B2

(12) United States Patent
Ambo et al.

(10) Patent No.: US 7,883,361 B2
(45) Date of Patent: Feb. 8, 2011

(54) CONNECTION MEMBER AND HARNESS CONNECTION BODY USING THE CONNECTION MEMBER

(75) Inventors: Tsugio Ambo, Tokyo (JP); Michiyasu Watanabe, Tokyo (JP); Tomokazu Matsumoto, Tokyo (JP); Tatsuyuki Amano, Tokyo (JP); Yoshikazu Tanaka, Tokyo (JP); Tetsu Hirose, Tokyo (JP)

(73) Assignee: Mitsubishi Cable Industries, Ltd., Tokyo (JP)

( * ) Notice: Subject to any disclaimer, the term of this patent is extended or adjusted under 35 U.S.C. 154(b) by 13 days.

(21) Appl. No.: 12/083,569

(22) PCT Filed: Oct. 26, 2006

(86) PCT No.: PCT/JP2006/321428

§ 371 (c)(1),
(2), (4) Date: Jan. 5, 2009

(87) PCT Pub. No.: WO2007/049724

PCT Pub. Date: May 3, 2007

(65) Prior Publication Data

US 2009/0305568 A1 Dec. 10, 2009

(30) Foreign Application Priority Data

| | | |
|---|---|---|
| Oct. 27, 2005 | (JP) | 2005-312774 |
| Feb. 21, 2006 | (JP) | 2006-043282 |
| Apr. 28, 2006 | (JP) | 2006-125490 |
| May 24, 2006 | (JP) | 2006-144253 |
| Oct. 5, 2006 | (JP) | 2006-273619 |

(51) Int. Cl.
*H01R 31/08* (2006.01)

(52) U.S. Cl. ..... 439/507; 439/722

(58) Field of Classification Search ..... 439/189, 439/507–509, 512, 722
See application file for complete search history.

(56) References Cited

U.S. PATENT DOCUMENTS

| | | | | |
|---|---|---|---|---|
| 5,106,318 | A | 4/1992 | Endo et al. | |
| 5,662,487 | A * | 9/1997 | Okamura et al. | 439/189 |
| 5,788,519 | A * | 8/1998 | Stern | 439/189 |
| 7,520,767 | B2 * | 4/2009 | Tamagawa et al. | 439/189 |

FOREIGN PATENT DOCUMENTS

| | | |
|---|---|---|
| JP | 61-124985 | 8/1986 |
| JP | 4-27587 U | 3/1992 |
| JP | 8-279382 A | 10/1996 |
| JP | 9-306617 A | 11/1997 |
| JP | 2005-71614 A | 3/2005 |
| JP | 2005-166408 A | 6/2005 |

* cited by examiner

*Primary Examiner*—Thanh-Tam T Le
(74) *Attorney, Agent, or Firm*—Holtz, Holtz, Goodman & Chick, PC

(57) ABSTRACT

A connection member of simple structure having a high reliability and capable of performing electric cable branching is provided. Connection portions of a plurality of electric cable terminals having an electric cable are respectively inserted into an electric cable terminal insertion hole of a holding body. Cylindrical contact points of the connection portions are aligned in a pin terminal insertion hole and a pin terminal is inserted into the pin terminal insertion hole. The pin terminal is successively inserted into the cylindrical contact points of the electric cable terminals arranged in parallel in the pin terminal insertion hole so that the pin terminal is electrically connected to the plurality of connection portions and the connection portions are short-circuited with one another.

5 Claims, 19 Drawing Sheets

CONNECTION MEMBER AND HARNESS CONNECTION BODY USING THE CONNECTION MEMBER

This application is a U.S. National Phase Application under 35 USC 371 of International Application PCT/JP2006/321428 filed Oct. 26, 2006.

TECHNICAL FIELD

The present invention relates to a connection member and a harness connection body using such a connection member for use in harness circuits of automobiles.

BACKGROUND OF THE INVENTION

In the harness circuits of automobiles, it is often required to extend a plurality of branch wires from a main wire. To this end, a technology has been known that a portion of an electrically insulating sheath covering the main wire is peeled off and a branch wire is connected to the exposed portion of the main wire by clamping. This method is called a splice joint method. There has been also known another connecting method called a joint connector method, in which a circuit branching connector is provided at an end portion of a main wire and a branch wire and main wire are connected to each other by means of multipurpose connectors and clamp terminals. This latter method has been described in the following Japanese Patent document.

Patent Document 1: Japanese Patent Kokai 2005-71614

PROBLEMS TO BE SOLVED BY THE INVENTION

In the former splice joint method, branch wires have to be connected one by one by clamping, and thus working efficiency is extremely lowered. Furthermore, it is difficult to connect branch wires to the main wire by clamping on a production line, and therefore this method could not be easily applied to a production on an assembly line.

The latter joint connector method has been developed to mitigate the drawbacks of the splice joint method. In the joint connector method, joint working could be performed on the harness manufacturing line, and therefore a higher working efficiency could be realized. Moreover, it is relatively easy to change or correct harness circuits. However, this method requires a lot of parts such as circuit branching connectors, multipurpose connectors, bass bars, terminals and so on. Therefore, a longer time is required to construct the wire harness by the joint connector method.

Particularly, in the joint connector method disclosed in the Japanese Patent Document 1, since the joint connector has a large size, a branch connection could not be provided at a desired position, but the branch wire has to be extended to a position where the joint connector could be arranged with a sufficient space. This results in that a size of the wire harness could not be minimized.

As explained above, the known joint connector method has various problems to be solved, i.e. a reduction of space, an improvement of working efficiency, a reduction of a number of parts and so on.

The present invention has for its object to provide a connection member and a harness connection body which can solve the above mentioned problems, has a simple structure, has a higher reliability and can assemble a wire harness much more easily.

BRIEF SUMMARY OF THE INVENTION

In order to attain the above object, according to the invention, a connection member comprises a pillar-shaped holding body having a pin terminal insertion hole extending in an axial direction of the holding body and a plurality of wire terminal insertion holes formed in a circumferential outer surface of the holding body such that the wire terminal insertion holes are communicated with the pin terminal insertion hole, into said plurality of wire terminal insertion holes being to be inserted a plurality of wire terminals; and a pin terminal to be inserted into said pin terminal insertion hole such that the pin terminal is brought into contact with said plurality of wire terminals to conductively connect said wire terminals to each other.

According to further aspect of the invention, a harness connection body using a connector member comprises a pillar-shaped holding body having a pin terminal insertion hole extending in an axial direction of the holding body and a plurality of wire terminal insertion holes formed in a circumferential outer surface of the holding body such that the wire terminal insertion holes are communicated with the pin terminal insertion hole; a plurality of wire terminals, each having, at one end, a connection portion inserted into said wire terminal insertion hole and, at the other end, an electric wire connected thereto; and a pin terminal inserted into said pin terminal insertion hole as well as said connection portions of the wire terminals to conductively connect said wire terminals to each other.

According to further aspect of the invention, a harness connection body comprises a pillar-shaped holding body having a pin terminal insertion hole extending in an axial direction of the holding body and a plurality of wire terminal insertion holes formed in a circumferential outer surface of the holding body such that the wire terminal insertion holes are communicated with the pin terminal insertion hole; a plurality of wire terminals, each having, at one end, a connection portion inserted into said wire terminal insertion hole and, at the other end, an electric wire connected thereto; a pin terminal inserted into said pin terminal insertion hole as well as said connection portions of the wire terminals to conductively connect said wire terminals to each other; a protection case accommodating therein said harness connection body having said holding body and wire terminals; and a waterproof member provided between an inlet opening of the protection case and the electric wires of the harness connection body.

MERITS OF THE INVENTION

In the connection member and the harness connection body according to the invention, the electric wires can be connected to each other merely by inserting the pin terminal, and the structure can be simplified, the reliable electrical connection between the electric wires can be attained, the number of parts can be reduced, space factor and workability can be improved, and cost can be reduced compared with the known connection member.

Moreover, longitudinal elongated grooves may be formed in the circumferential outer surface of the holding body and the electric wires are accommodated within these elongated grooves, a whole diameter can be reduced, and a size of the connection member can be further decreased.

Furthermore, since a size of the harness connection body according to the invention is small, the harness connection body can be arranged at any place within a harness and a desired circuit arrangement can be realized without extending the electric wires.

BEST MODE OF THE INVENTION

Figure 1:
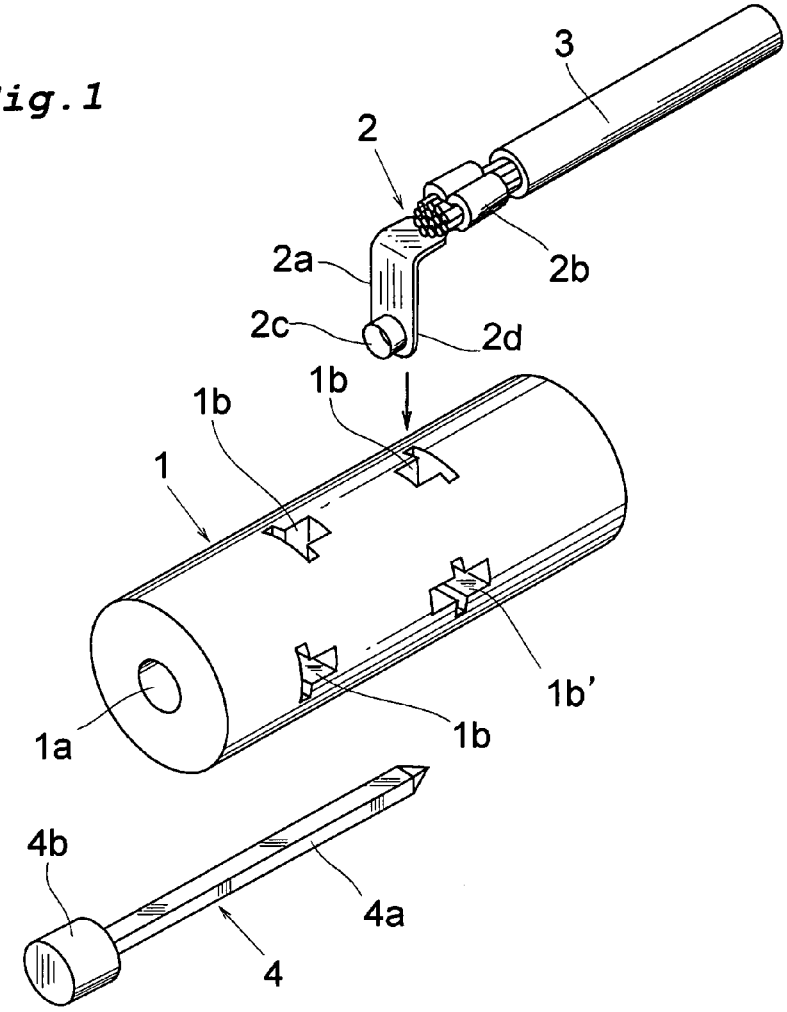
FIG. 1 is a perspective view of the first embodiment.

Now the present invention will be explained in detail with reference to the embodiments of the invention shown in the drawings.

Embodiment 1

A harness connection body of the embodiment 1 mainly includes a cylindrical holding body 1 having a pin terminal insertion hole 1*a* and a plurality of wire terminal insertion holes 1*b* as shown in FIG. 1, a plurality of wire terminals 2 each having a connection portion 2*a* at a front portion and a clamp portion 2*b* to which an electric wire 3 is connected at a rear portion, a through pin 4 having a pin terminal 4*a* to be inserted into the pin terminal insertion hole 1*a* and a grip portion 4*b*.

In the circumferential outer surface of the holding body 1 there are formed a plurality of wire pin insertion holes 1*b* such that these wire pin insertion holes are communicated with the pin terminal insertion hole 1*a* formed along a longitudinal center axis of the holding body 1. Each of the connection portions 2*a* of the wire terminals 2 is inserted into respective one of the wire terminal insertion holes 1*b*.

It should be noted that it is sufficient to form the pin terminal insertion hole 1*a* such that it extends in an axial direction of the holding body 1. That is to say, the pin terminal insertion hole 1*a* may be aligned with the center axis of the holding body 1 or may be shifted from the center axis. A position of the pin terminal insertion hole 1*a* may be suitably determined in accordance with a harness circuit to be formed or kinds of electric wires to be connected to each other.

The holding body 1 may be formed into an elliptical pillar or rectangular pillar instead of a cylindrical shape. The holding body 1 may be made of a thermoplastic resin. Particularly, polybutylene terephthalate (PBT) and polypropylene (PP) may be advantageously used, because such materials have a high thermal deformation point, a high rigidity, a good electrically insulating property and an improved mechanical property. A size of the holding body may be determined in accordance with diameters of electric wires. Typically, a diameter of the holding body 1 is about 5-30 mm and a length is about 20-150 mm.

In general, the holding body 1 may be formed by injecting thermoplastic resin (PBT or PP) into a given mold, but it is also possible to manufacture the holding body by cutting the pin terminal insertion hole 1*a* and wire terminal insertion holes 1*b* into a previously manufactured pillar-shape body.

The pin terminal insertion hole 1*a* may have various cross sectional shapes such as circular, elliptical, triangular, rectangular, polygonal shapes. A circular hole is most favorite in view of easiness of molding. It should be noted that it is not always necessary to form the pin terminal insertion hole 1*a* as a through-hole, but the other end of the pin terminal insertion hole may be closed.

The wire terminal insertion hole 1*b* is formed such that the connection portion 2*a* of the wire terminal 2 can be inserted into a given position and a front portion of the connection portion 2*a* is communicated with the pin terminal insertion hole 1*a*. The wire terminal insertion hole 1*b* may have any desired shape, and in the embodiment shown in FIG. 1, the wire terminal insertion hole 1*b* has a shape corresponding to an outer configuration of the connection portion 2*a*. Then, an erroneous wire terminal having different shape could not be inserted into the wire terminal insertion hole 1*b*. Furthermore, if the wire terminal insertion hole 1*b*' has a shape as shown in FIG. 1 and an inserting direction of the connection portion 2*a* is not limited, the connection portion 2*a* of the wire terminal could be inserted from either direction.

It is sufficient that the wire terminal insertion hole 1*b* is formed to be communicated with the pin terminal insertion hole 1*a*, but the wire terminal insertion hole 1*b* may be formed to extend beyond the pin terminal insertion hole 1*a* up to an opposite surface of the holding body. Then, it is possible to confirm an insertion of the wire terminal 2 from the opposite side. In this manner, the number of positions for inserting the connection portion 2*a* can be increased and a freedom of assembling the harness circuit is improved.

Figure 2:
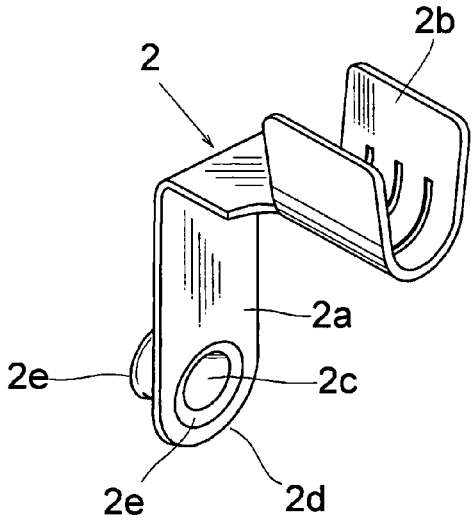
FIG. 2 is a perspective view showing a wire terminal.

The wire terminal 2 is formed by punching a single metal plate. As illustrated in FIG. 2, at a front portion of the wire terminal there is formed a cylindrical contact 2*c* by reducing work and at a rear end there is formed a clamp portion 2*b*. It should be noted that in the drawing the electric wire is not yet connected to the wire terminal.

A front edge portion 2*d* of the connection portion 2*a* is formed into a semicircular shape having a center of curvature corresponding to the center axis of the cylindrical contact 2*c* and a radius of the front edge portion 2*d* is substantially identical with a radius of the pin terminal insertion hole 1*a* formed in the holding body 1. Tapered guide portions 2*e* are provided at both ends of the cylindrical contact 2*c* such that the pin terminal 4*a* can be easily inserted into the cylindrical contact.

Figure 3:
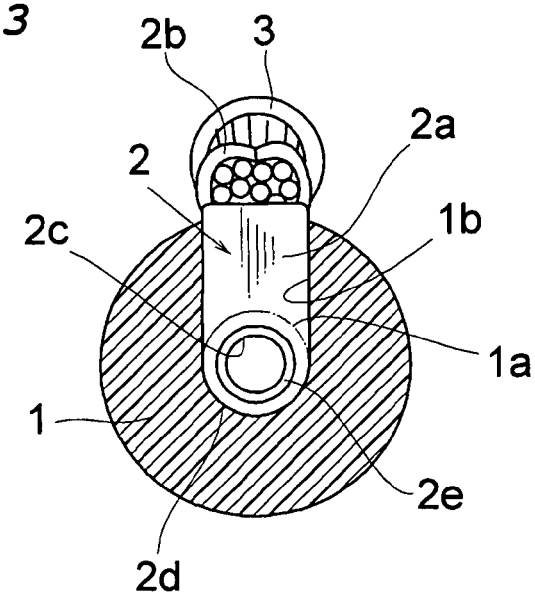
FIG. 3 is a lateral cross sectional view illustrating a condition in which a wire terminal is inserted into a holding body.

When the connection portion 2*a* of the wire terminal 2 is inserted into the pin terminal insertion hole 1*a* through the wire terminal insertion hole 1*b*, a center axis of the cylindrical contact 2*c* is aligned with a center axis of the pin terminal insertion hole 1*a* as depicted in FIG. 3.

The wire terminal 2 may be formed in various manners. Given shape members are formed by punching a copper or copper alloy plate and are deformed into the wire terminals having a desired shape by molding, and finally the wire terminals are plated with Sn. Alternatively, the wire terminals can be formed by punching a Sn plated copper or copper alloy plate into members of desired shape, and then these members are deformed into the wire terminals by molding. The wire terminal 2 is preferably made of brass in view of mechanical strength and electrically conductivity. It should be noted that the wire terminal may be improved by Sn plating, because corrosion resistance of the wire terminal is increased and a good electrical contact of the wire terminal with the pin terminal 4*a* can be obtained.

Figure 4:
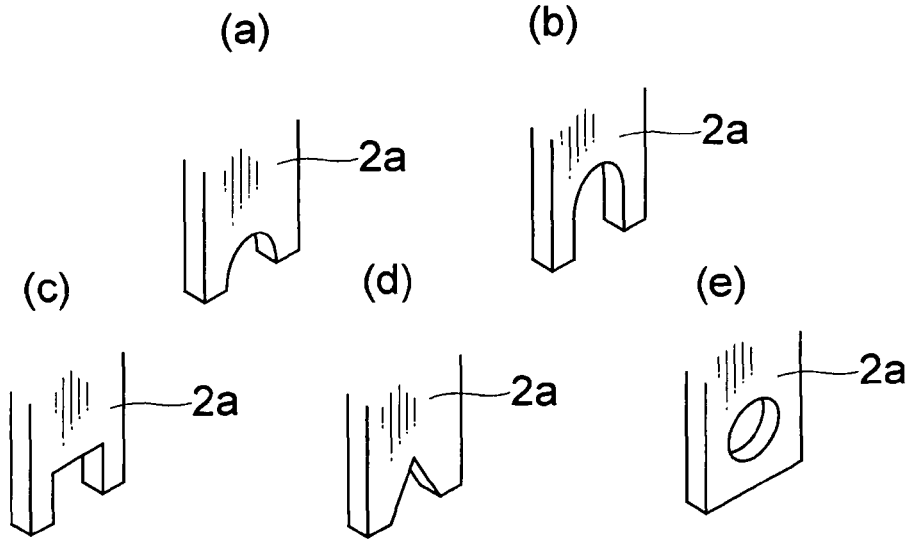
FIG. 4 is a perspective view showing a modified embodiment of a connection portion.

The connection portion 2*a* may have any shape as long as the electrical contact can be attained by a contact with the pin terminal 4*a*. Not only the cylindrical shape shown in FIG. 2, but also the connection portion may be formed into various shapes. For instance, the connection portion may be formed into semicircular (FIG. 4*a*), U-shape (FIG. 4*b*), rectangular shape (FIG. 4*c*), V-shape (FIG. 4*d*) and circular (FIG. 4*e*). In order to attain a good and effective conduction between the connection portion 2*a* and the pin terminal 4*a*, the connection portion 2*a* is preferably formed into cylindrical and circular shape. Particularly, the connection portion 2*a* having the cylindrical shape is most preferable, because a largest contact surface can be realized.

The electric wire 3 is formed by coating an electrically insulating sheath around an electrical conductor. Any electric wires having conventional diameters may be utilized. The electrical conductor may be formed by twisted soft or hard copper conductors, or may be made of a single conductor or twisted conductors of Cu—Sn alloy. This material has a sufficient tensile strength even though a diameter of the conductor is reduced and has been used in the automobile harnesses. The electrically insulating sheath may be made of any known insulating material. Particularly, in view of the environment, the insulating sheath is preferably made of a non-halogen insulating material.

The electrical conductor of the electric wire 3 may be connected to the wire terminal 2 by any known method such as caulking, welding, soldering and clamping. In view of working time for making the branch connection and a mechanical strength of the connection, it is preferable to connect the electric wire to the wire terminal by the clamping operation using the clamp portion 2*b*.

The pin terminal 4*a* of the through pin 4 is formed by a rod-like member such that the connection portions 2*a* of a plurality of wire terminals 2 can be connected in an electrically conductive manner. The pin terminal 4*a* may have any cross sectional shape such as circular triangular, rectangular and polygonal. In the present embodiment, the pin terminal 4*a* has a circular cross sectional shape owing to the reason that it could attain a stable connection and positive conduction and that the pin terminal 4*a* can be inserted with a small force.

It is preferable that the pin terminal 4*a* is made of a material having a harder metal than a material of the connection portion 2*a*. Then, the connection portion 2*a* of the wire terminal 2 is deformed during the insertion of the pin terminal 4*a*. A hardness of the pin terminal 4*a* as well as the connection portion 2*a* may be adjusted by suitably selecting the working process, heat treatment and raw material. Furthermore, in order to positively insert the pin terminal 4*a* into the connection portion 2*a*, a front end of the pin terminal is preferably formed into a conical shape such as cone, geometrical-pyramid, frust-cone and frust-geometrical-pyramid.

Figure 5:
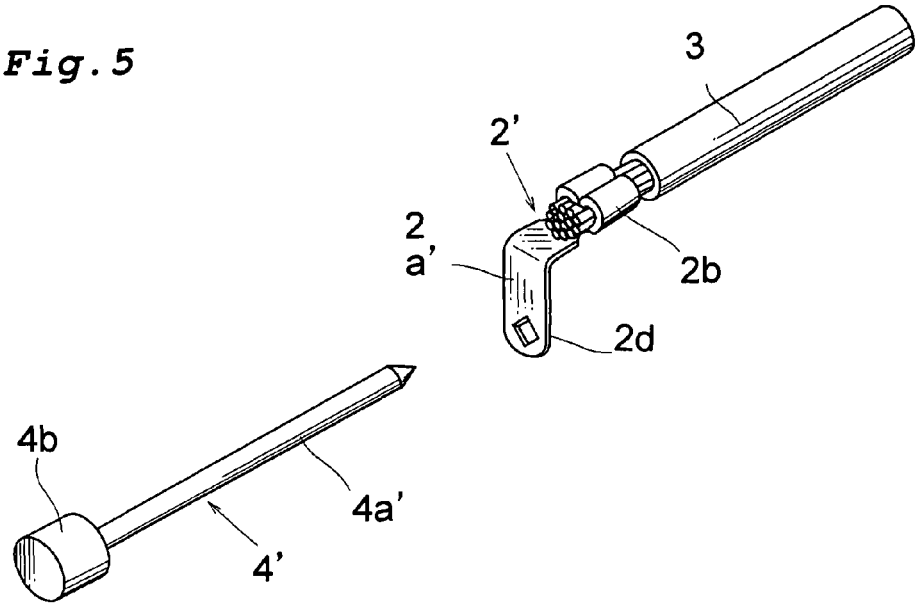
FIG. 5 is a perspective sectional depicting another embodiment of a through pin and a wire terminal.

FIG. 5 is a perspective view showing another embodiment of an assembly of a through pin 4' and a cooperating wire terminal 2'. The through pin 4' includes a pin terminal 4*a*' having a circular cross section, and the wire terminal 2' includes a connection portion 2*a*' having a rectangular contact hole.

Now it is assumed that the contact portion of the connection portion 2*a* having a circular or cylindrical cross sectional shape has an inner diameter of d1 and the pin terminal 4*a* having a circular cross sectional shape has a diagonal length of x. Then, it is preferable to set d1<x. The pin terminal 4*a* may have a circular cross sectional shape having an outer diameter of d2 and the contact portion of the connection portion 2*a* may be formed into a rectangular shape having a side length of d1. In this case, it is preferable to set d1<d2.

The pin terminal 4*a* having a circular or rectangular cross sectional shape may be formed in the following manner. A mother material made of copper, copper alloy or preferably brass due to its high strength and good conductivity is first extended by dies roll or rolling mill under a cold condition into a wire having a circular or rectangular cross section. Then, after plating the wire with Sn, the wire is cut into a piece having a given length. Finally a tip portion of the thus obtained piece is deformed into a cone or frust-cone.

Figure 6:
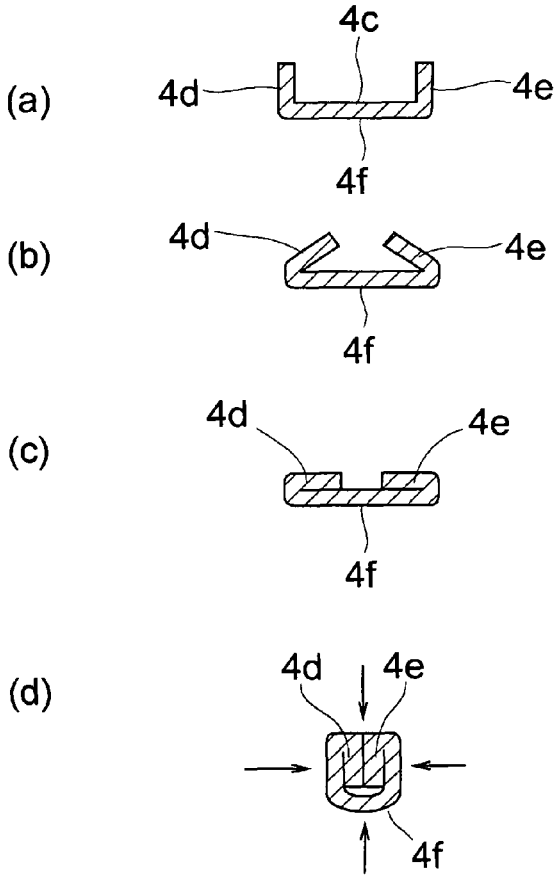
FIG. 6 is an explanatory view explaining a manufacturing process of a pin terminal.

As shown in FIG. 6, an Sn-plated metal plate 4*c* made of copper, copper alloy or brass is obtained by punching, and then the metal plate 4*c* is folded and compressed to increase a mechanical strength. That is to say, both side portions 4*d*, 4*e* of the metal plate 4*c* are bent upward with respect to a base portion 4*f* as depicted in FIG. 6(*a*), the side portions 4*d*, 4*e* are further bent inward as illustrated in FIG. 6(*b*) until the side portions are laid over the base portion 4*f* as shown in FIG. 6(*c*). Finally, the thus folded side portions 4*d*, 4*e* are folded together with the base portion 4*f* such that the side portions 4*d*, 4*e* are brought into contact with each other, and a whole assembly is compressed from four directions.

Figure 7:
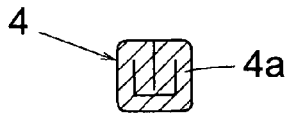
FIG. 7 is a lateral cross sectional view representing the pin terminal.

In this manner, the pin terminal having a substantially rectangular cross section and having no void within the body can be obtained as illustrated in FIG. 7. A tip portion of the pin terminal may be deformed into a cone shape by pressing or cutting. By performing such hardening process, it is possible to obtain the pin terminal 4*a* having a small dimension and hardly being curved or broken.

In order to insert the pin terminal 4*a* of the through pin 4 into the connection portion 2*a* of the wire terminal 2, a certain force is required. To this end, a grip portion 4*b* of a cylindrical shape is preferably provided at an end of the through pin 4. An outer diameter of the grip portion 4*b* is larger than an inner diameter of the pin terminal insertion hole 1*a*, and thus an insertion depth of the pin terminal 4*a* into the pin terminal insertion hole 1*a* can be limited.

Then it is preferably checked whether or not the pin terminal 4*a* having a given length has been inserted up to a desired position. The grip portion 4*b* may be made of any electrically insulating material. The grip portion should not be broken by a substantial force applied thereto. The grip portion 4*b* may be made of synthetic resin such as polybutylene terephthalate, polypropylene and polyethylene. It should be noted that if it is not necessary to remove the pin terminal 4*a* from the pin terminal insertion hole, the grip portion 4*b* may be dispensed with. Then, the pin terminal may be inserted with a suitable jig.

Figure 8:
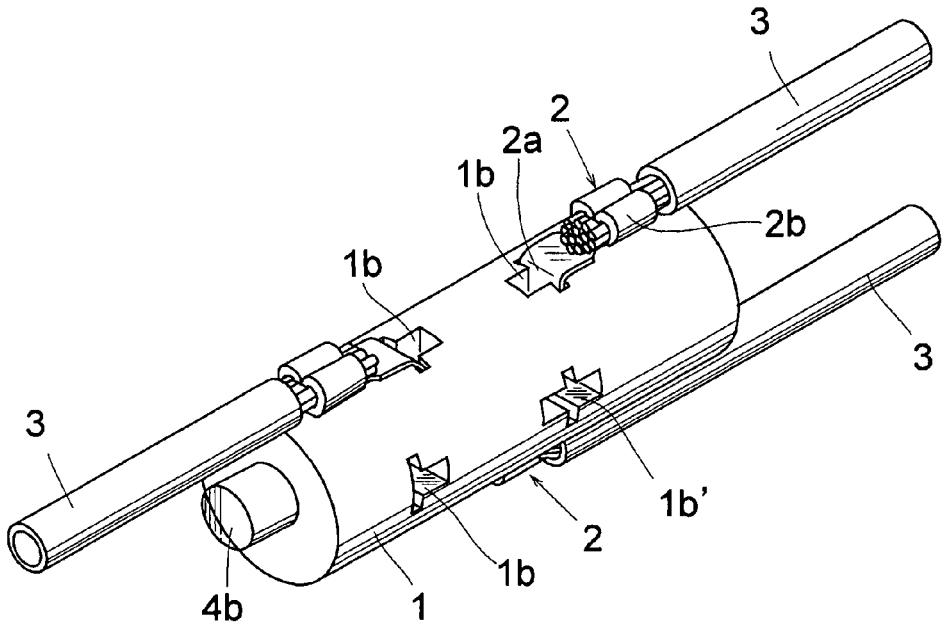
FIG. 8 is a perspective view showing the harness connection body.
Figure 9:
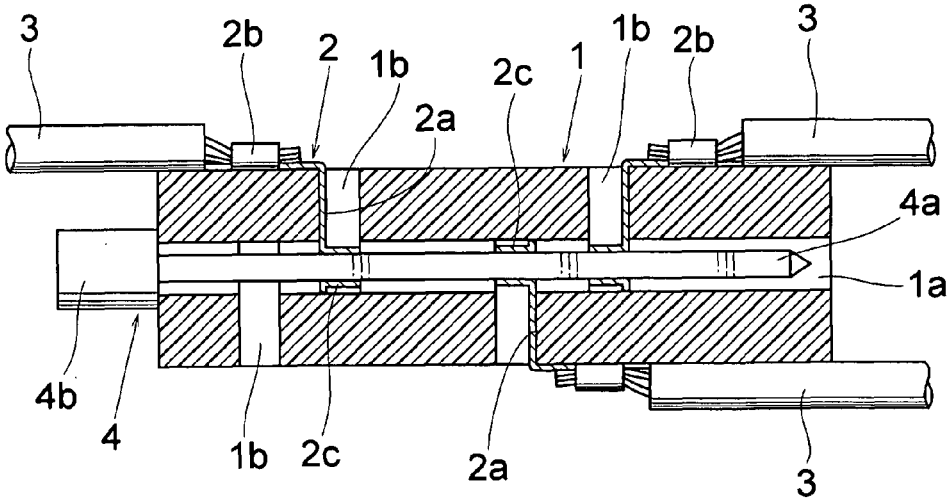
FIG. 9 is a longitudinal cross sectional view illustrating the harness connection body.

FIGS. 8 and 9 are perspective and cross sectional views, respectively showing the harness connection body comprising the holding body 1, wire terminal 2 and through pin 4. The connection portions 2*a* of the required number of wire terminals 2 having the electric wires 3 connected thereto are inserted into the wire terminal insertion holes 1*b* of the holding body 1, and then the pin terminal 4*a* is inserted into the pin terminal insertion hole 1*a*. The pin terminal 4*a* passes through the connection portion 2*a* of the wire terminals 2 successively such that the connection portions 2*a* are electrically connected to the pin terminal 4*a*. In this manner, the connection portions 2*a* are electrically connected to one another.

It should be noted that two through pins 4 may be inserted into the pin terminal insertion hole 1*a* from both sides. In this case, if lengths of these pin terminals are set such that the pin terminals are not brought into contact within the pin terminal insertion hole 1*a*, a short circuit of the wire terminals 2 formed by one of the two through pins 4 can be electrically isolated from a short circuit of the wire terminals 2 constituted by the other through pin 4.

In the connection member according to the invention, the electrically conductive connection is established by one or more through pins 4, and therefore the wire terminals 2 can be made small in size. Moreover, an outer configuration of the thus assembled connection member has a cylindrical shape, and thus it can be easily assembled in the harness. Furthermore, since the wire terminals are arranged around the through pin 4, interference between the electric wires 3 can be reduced compared with the known spring contact structure.

Figure 10:
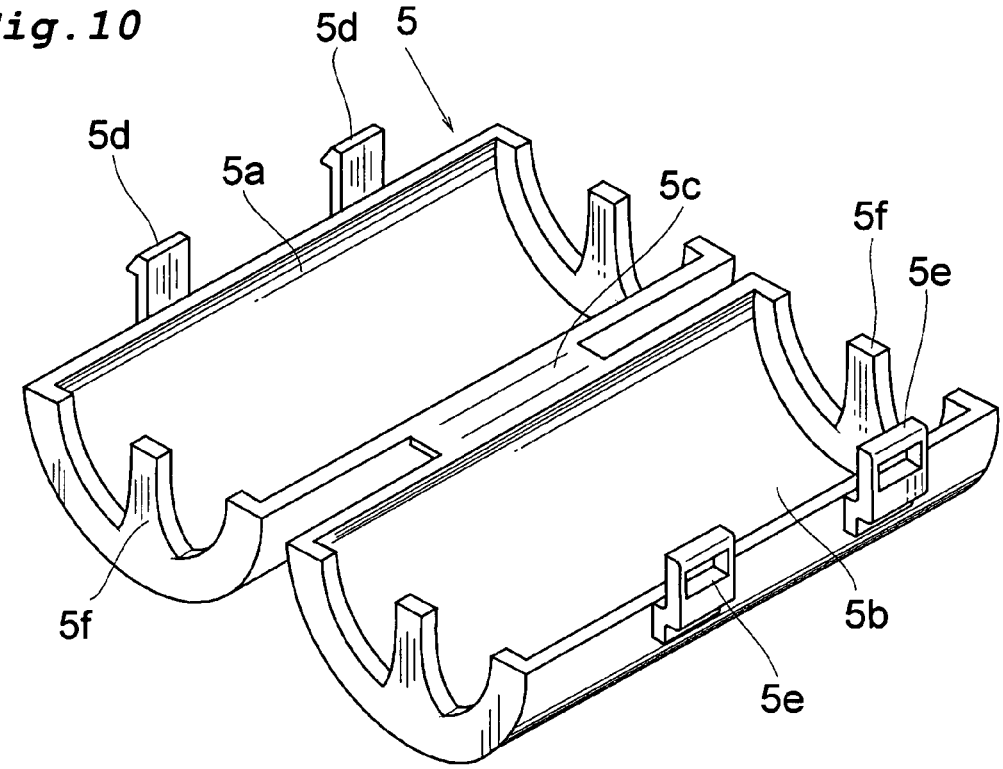
FIG. 10 is a perspective view depicting a protection cover.
Figure 11:
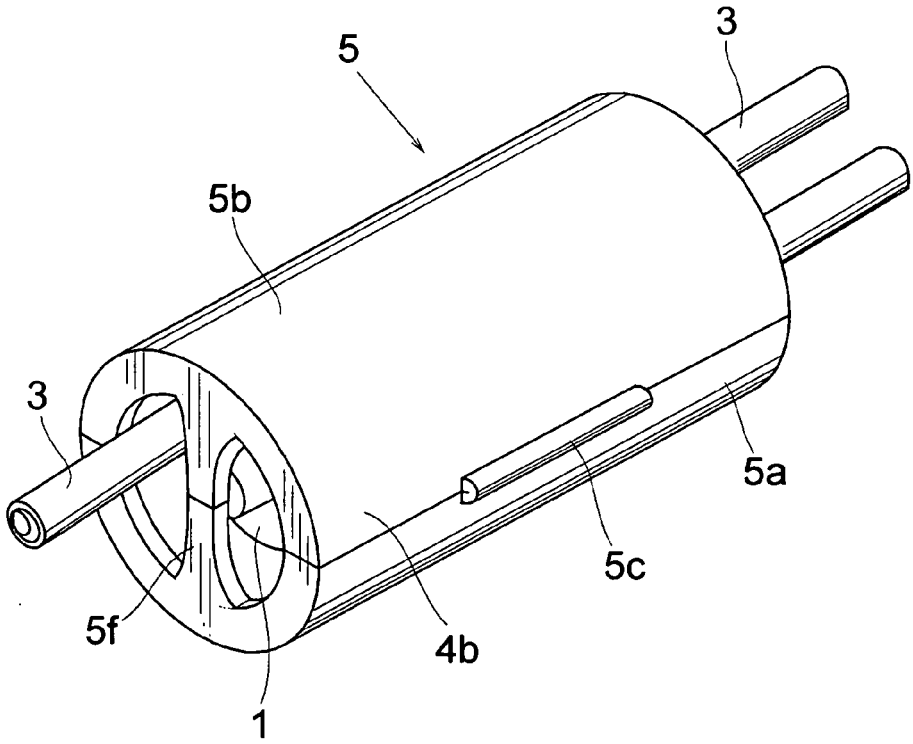
FIG. 11 is a perspective view showing an assembly of the protection cover having the harness connection body installed therein.

After extending the electric wires 3 along the holding body 1, a whole assembly may be fixed by winding an electrically insulating tape. Alternatively, the assembly can be covered with a protection cover 5 shown in FIG. 10. The protection cover 5 serves to protect the electric wires 2, to improve the electrical insulation and to protect the assembly from damage. The protection cover 5 has a substantially sleeve-like configuration and comprises two halves 5*a* and 5*b* which are connected to each other by hinges 5*c*. The two halves 5*a* and 5*b* can be coupled with each other by means of locking members 5*d* and 5*e*. At both ends of the halves 5*a* and 5*b*, there are formed projections 5*f* which are urged against the grip portion 4*b* to prevent the through pin 4 from being removed from the pin terminal insertion hole. FIG. 11 is a perspective view illustrating the assembly of the harness connection body and protection cover 5.

Embodiment 2

Figure 12:
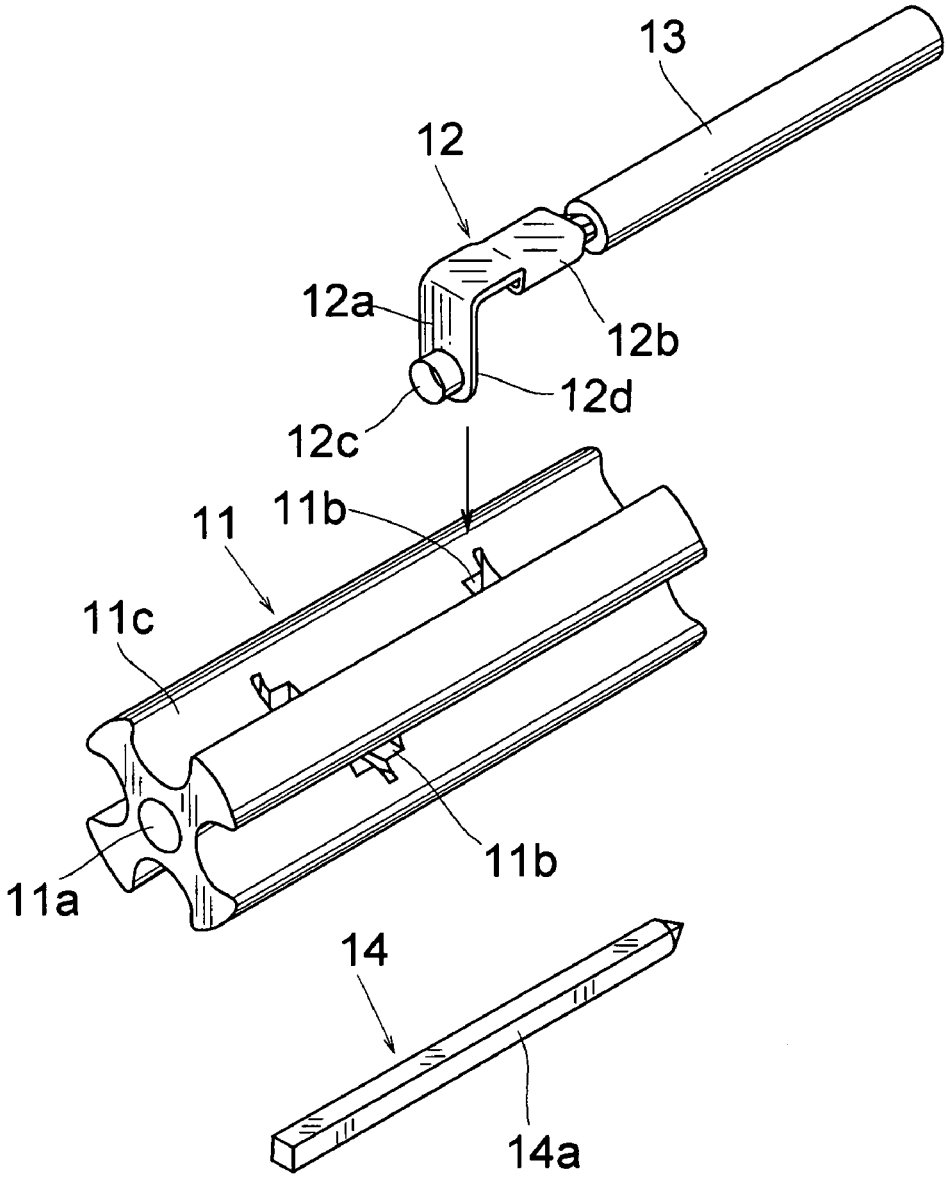
FIG. 12 is an exploded perspective view of the second embodiment.

The harness connection body of the second embodiment comprises a holding body 11 including a pin terminal insertion hole 11*a*, wire terminal insertion holes 11*b* and elongated grooves 11*c* as shown in FIG. 12, a plurality of wire terminals 12 each including a connection portion 12*a* to be inserted into the wire terminal insertion hole 11*b* and a clamp portion to which an electric wire 13 is connected, and a through pin 14 including a pin terminal 14*a*.

The holding body 11 is made of a synthetic resin and the pin terminal insertion hole 11*a* is formed along a center axis of the holding body. In an outer surface of the holding body 11 there are formed a plurality of, e.g. four elongated grooves 11*c* each having a semi-circular cross section. In a bottom surface of each of the elongated grooves 11*c* one or more wire terminal insertion holes 11*b* are formed such that the wire terminal insertion holes are communicated with the central pin terminal insertion hole 11*a*. The connection portion 12*a* of the wire terminals 12 are inserted into respective wire terminal insertion holes 11*b*.

At the connection portion 12*a* provided at a front end of the wire terminal 12 there is provided a tubular contact 12*c* formed by stamping, and at a rear end there is formed a clamp portion 12*b*.

Figure 13:
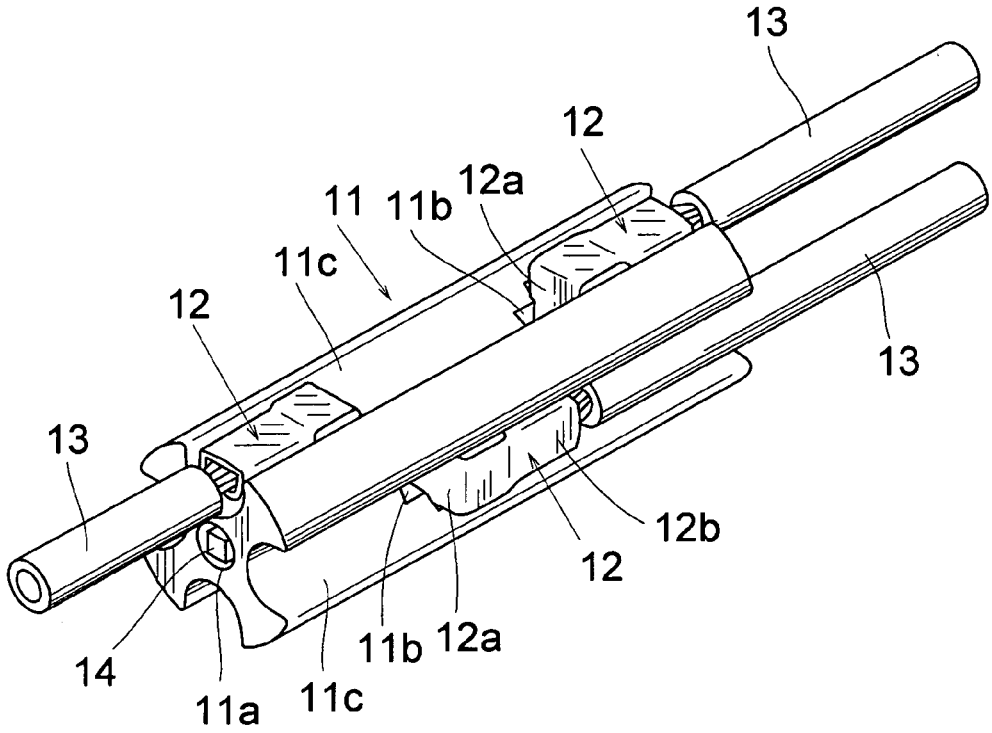
FIG. 13 is a perspective view showing the harness connection body.
Figure 14:
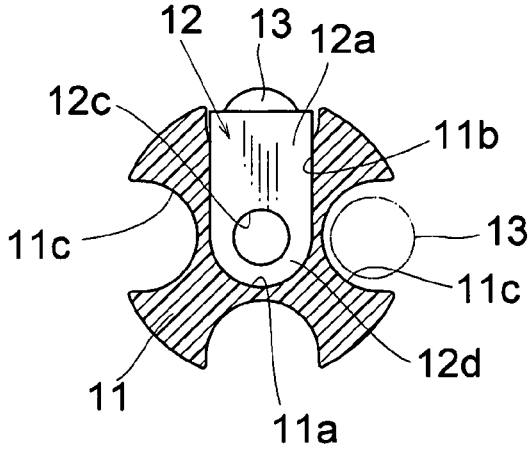
FIG. 14 is a lateral cross sectional view illustrating a condition in which a wire terminal is inserted into a holding body.

Upon assembling, the connection portion 12*a* of the wire terminal 12 to which the electric wire 13 is connected is inserted into the wire terminal insertion hole 11*b* from a direction shown by an arrow in FIG. 12, and the electric wire 13 is extended within the elongated groove 11*c* as illustrated in FIG. 13. Since a front edge 12*d* of the connection portion 12*a* has a radius substantially identical with that of the pin terminal insertion hole 11*a*, the connection portion 12*a* can be stably sit within the pin terminal insertion hole 11*a* and a center axis of the tubular contact 12*c* is coincided with a center axis of the pin terminal insertion hole 11*a* as depicted in FIG. 14. In this condition, the electric wire 13 is accommodated within the elongated groove 11*c* and does not protrude from an outer configuration of the holding body 11 to a large extent. That is to say, an outer configuration of the electric wires 13 is substantially identical with an outer configuration of the holding body 11.

The though pin 14 does not have the grip portion 4*b* of the first embodiment 1, and thus the through pin terminal 14*a* is inserted into the pin terminal insertion hole 11*a* with a suitable jig. Then, the pin terminal 14*a* is passed through the tubular contacts 12*c* of the connection portions 12*a* of successive wire terminals 12. In this manner, all the wire terminals 12 are short-circuited by the pin terminal 14*a* and whole electric wires 13 are electrically connected with one another.

Figure 15:
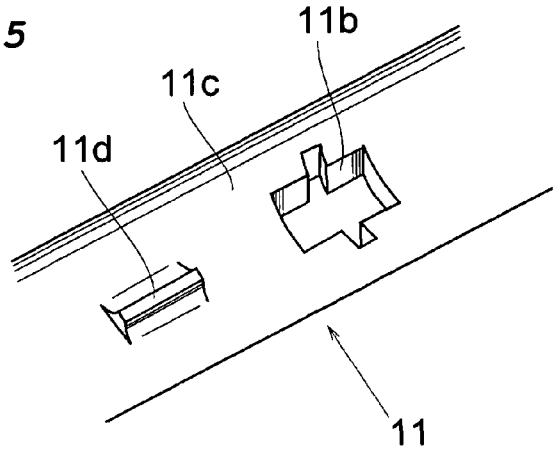
FIG. 15 is a perspective view depicting a projection formed in an elongated groove.

In order to support the wire terminal 12 stably, in the surface of the elongated groove 11*c* there is formed a projection 11*d* having a shape corresponding to an outer shape of the clamp portion 12*b* of the wire terminal 12 as shown in FIG. 15. Furthermore, it is possible to form the wire terminal insertion hole 11*b* in the elongated groove 11*c* such that the connection portion 12*a* can be inserted into the hole in either direction. Moreover, on surfaces of the holding body 11 and elongated grooves there may be provided arrows or marks indicating directions from which the through pin 14 is inserted and into which the electric wire 13 is extended.

Figure 16:
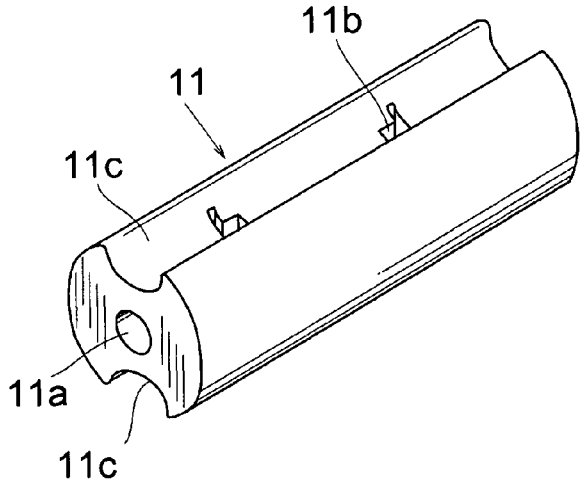
FIG. 16 is a perspective view showing a modified embodiment of the holding body.

FIG. 16 shows a modified embodiment of the holding body 11. In this embodiment, two elongated grooves 11*c* are formed. It should be noted that according to the invention, the number of the elongated grooves 11*c* is not limited to two and four, but one or three or more than four elongated grooves may be formed.

Figure 17:
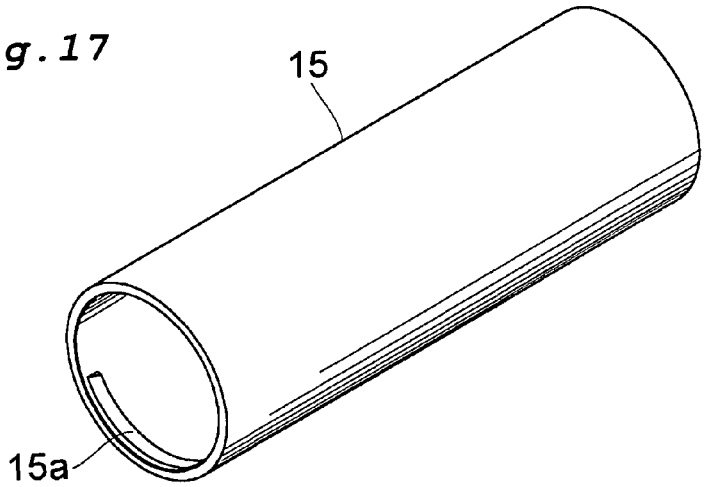
FIG. 17 is a perspective view depicting the protection cover.
Figure 18:
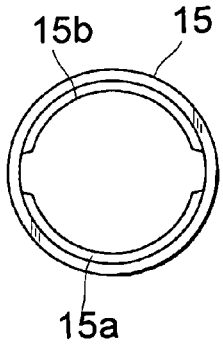
FIG. 18 is an end view of the protection cover.

FIGS. 17 and 18 are a perspective view and an end view, respectively showing a protection cover enclosing the harness connection body of the second embodiment. The protection cover 15 is formed by a tubular body made of a hard synthetic resin, and semi-circular protrusions 15*a* and 15*b* are formed on an inner surface of the protection cover at both end portions.

An inner diameter of the protection cover 15 is slightly larger than an outer diameter of the holding body 11 having a substantially tubular shape. A distance between top surfaces of the protrusion 15*a* and 15*b* and opposing inner walls of the protection cover is slightly shorter than an outer diameter of the holding body 11. Both ends of the protrusions 15*a* and 15*b* are tapered such that the holding body 11 can be easily inserted therein. A distance between the protrusion 15*a* and the protrusion 15*b* measured in an axial direction is slightly longer than a length of the holding body 11.

In order to apply the protection cover 15 onto the harness connection body including the holding body 11, wires 13 and so on, after a plurality of electric wires 13 have been previously passed through the protection cover 15, both end portion of the protection cover 15 are pressed by fingers such that a distance between the protrusion 15*a* and an opposing end portion of the protection cover is slightly increased, and then the holding body 11 is inserted into the protection cover 15. That is to say, said distance between the protrusion and the opposing portion is made larger than an outer diameter of the holding body 11, and therefore the holding body can be inserted into the protection cover 15. After that, the protection cover 15 is further slid over the holding body 11 until the other protrusion 15*b* extends beyond the other side end of the holding body 11 and a diameter of the protection cover is decreased into the original diameter.

Figure 19:
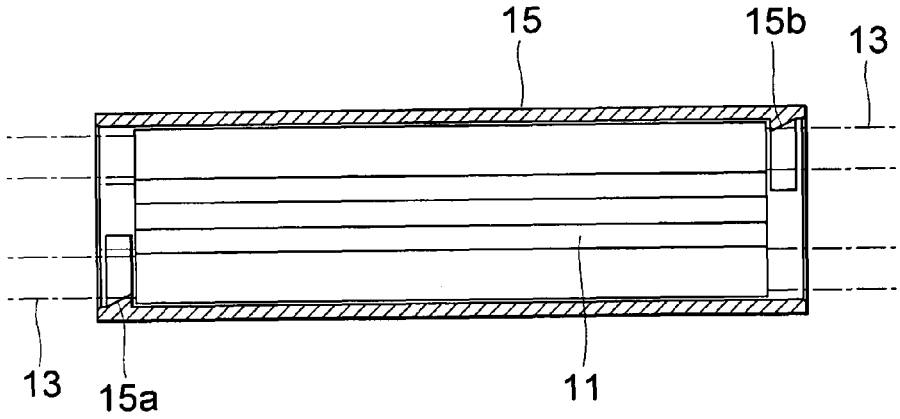
FIG. 19 is a longitudinal cross sectional view showing a condition in which the protection cover is applied on the connection member.

Under this condition, the protrusions 15*a* and 15*b* formed at both ends of the protection cover 15 positioned outside with respect to the side ends of the holding body 11 such that the holding body is clamped between the protrusions as shown in FIG. 19. Therefore, the connection member 12 can be effectively prevented from being removed from the protection cover 15. Since the protection cover 15 is made of an electrically insulating material, the electrical insulation of the holding body 11 is improved and the holding body is protected against damage or injure.

Figure 20:
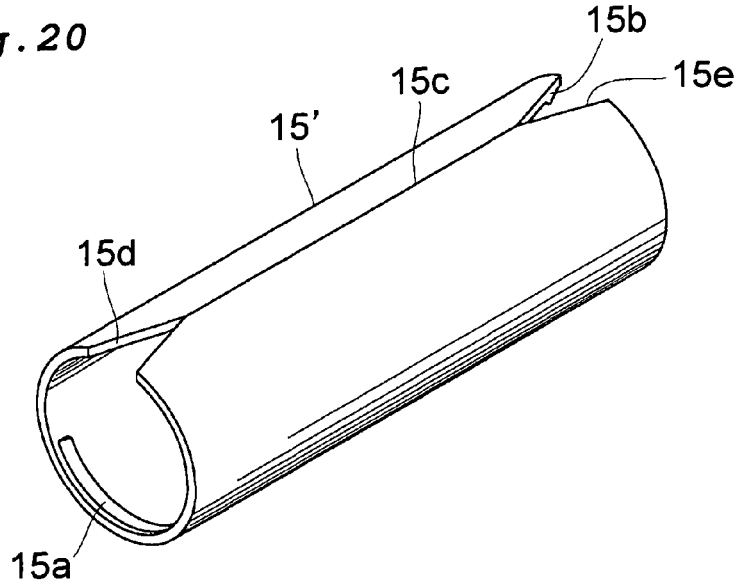
FIG. 20 is a perspective of the modified embodiment of the protection cover.

FIG. 20 is a perspective view showing a modified embodiment of the protection cover 15'. In the protection cover 15' includes a longitudinal slit 15*c* and cut-out portions 15*d* and 15*e* are formed at both end portions of the slit 15*c* such that the slit can be opened easily. On inner surface of the protection cover 15' there are formed semi-circular protrusions 15*a* and 15*b* at both side end portions like the protection cover 15 of the first embodiment.

When the protection cover 15' is to be applied onto the holding body 11, the slit 15*c* is opened by means of the cut-out portions 15*d* and 15*e* and a plurality of electric wires 13 are passed through the protection cover 15'. After that, the protection cover 15' is moved into the holding body 11, and the protection cover 15' is applied on the holding body 11 in the same manner as that explained above in the first embodiment.

In this modified embodiment, it is no more necessary to pass the electric wires 13 through the protection cover 15' previously. The electric wires 13 may be passed through directly before the insertion of the holding body into the protection cover.

Embodiment 3

Figure 21:
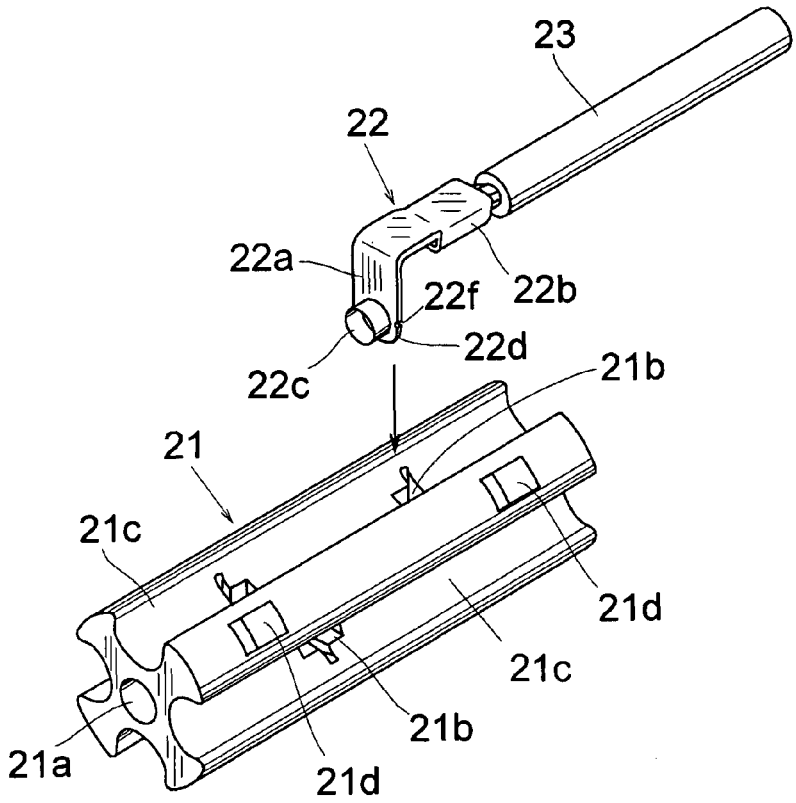
FIG. 21 is an exploded perspective view showing the modified embodiment 3.

In this embodiment 3 illustrated in FIG. 21, the connection member is mainly consisting of a holding body 21 including a pin terminal insertion hole 21*a*, wire terminal insertion holes 21*b* and elongated grooves 21*c*; a plurality of wire terminals 22 each including a connection portion 22*a* to be inserted into the wire terminal insertion hole 21*b* of the holding body 21 and a clamp portion to which an electric wire 23 is connected; and a through pin 14 shown in FIG. 12.

An outer configuration of the holding body 21 is substantially identical with that of the holding body 21 depicted in FIG. 12, but in the present embodiment, a suitable number of fitting projections 21*d* in a shape of block are provided on a circumferential surface of the holding body 21.

Figure 22:
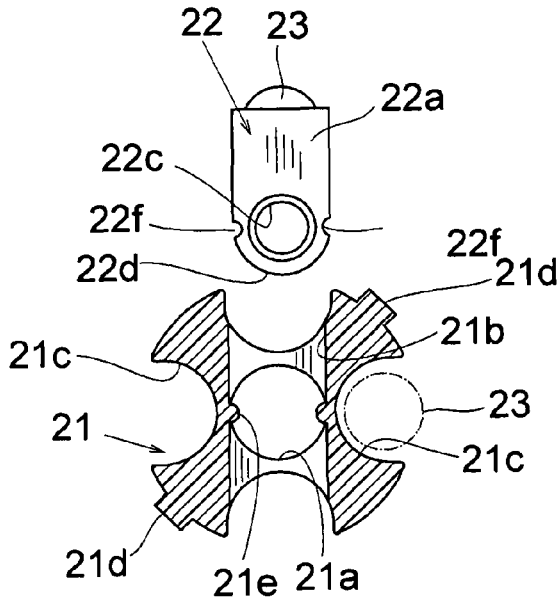
FIG. 22 is a lateral cross sectional view of a combination of the holding body and wire terminal.

Each of the wire terminal insertion holes 21*b* provided at the bottoms of the elongated grooves 21*c* has a such configuration that a connection portion 22*a* of a wire terminal 22 can be easily inserted as illustrated in a lateral cross sectional view of FIG. 22. Substantially at a middle of the wire terminal insertion hole 21 there are formed semi-circular engaging projections 21*e* extending inwardly from an inner surface of the wire terminal insertion hole.

Figure 23:
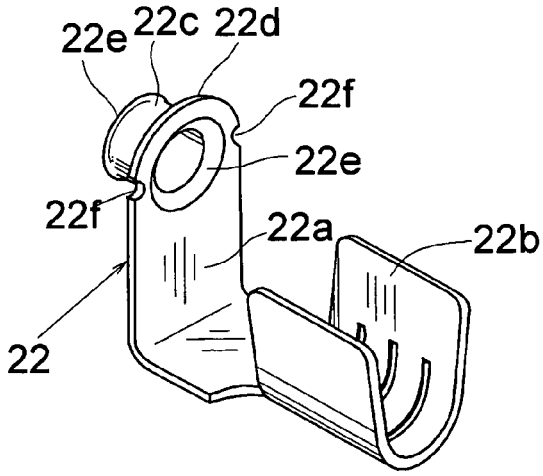
FIG. 23 is a perspective view depicting the wire terminal.

A front end 22*d* of the connection portion 22*a* is formed into a semi-circular shape as illustrated in FIG. 23, and engaging depressions 22*f* are formed in both sides of the connection portion 22, said engaging depressions 22*f* being engaged with the engaging projections 21*e* formed in the wire terminal insertion hole 21*b* such that the connection portion 22*a* is positioned by said engagement viewed in the inserting direction.

Figure 24:
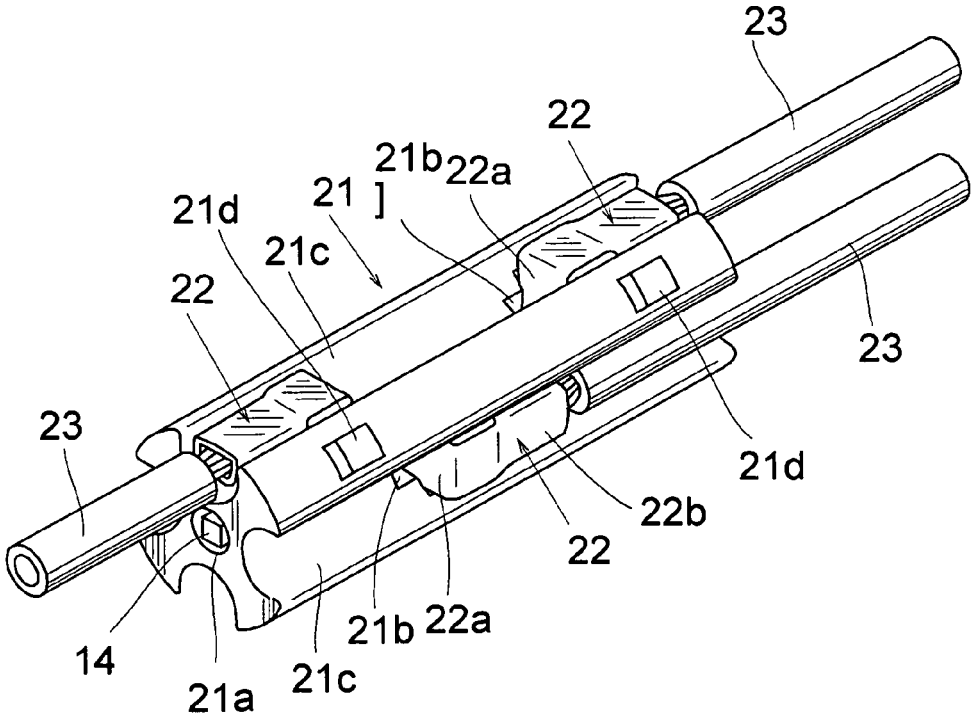
FIG. 24 is a perspective view of the harness connection body.
Figure 25:
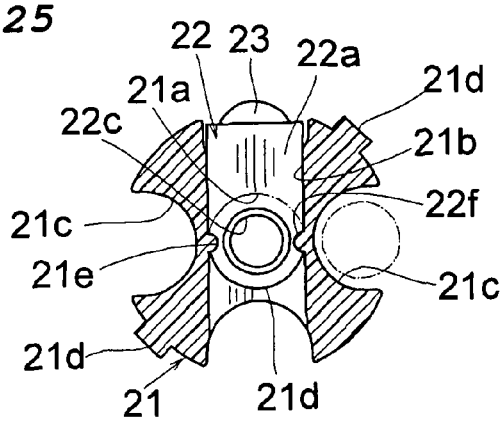
FIG. 25 is a lateral cross sectional view showing a condition in which the wire terminal is inserted into the holding body.

Upon assembling the connection member, a connection portion 22*a* of a wire terminal 22 to which an electric wire 23 is connected is inserted from a direction denoted by an arrow in FIG. 21 and the electric wire 23 is arranged to be accommodated within an elongated groove 21*c* as shown in FIG. 24. During the insertion of the connection portion 22*a*, the engaging depressions 22*f* are engaged with the engaging projections 21*e* formed in the wire terminal insertion hole 21*b*, and thus the connection portion 22*a* is stably held in position within the wire terminal insertion hole 21*b* in a direction of the insertion and a center of a tubular contact 22*c* is coincided with a center of the pin terminal insertion hole 21*a*.

It should be noted that when a size of the engaging projections 21*e* is slightly smaller than a size of the engaging depressions 21*f*, although there might be any slight positional error or allowable error, the connection portion 22*a* can be inserted while correcting any error and can be positioned at a correct point within the pin terminal insertion hole 21*a*.

In this condition, a pin terminal 14*a* of a through pin 14 is inserted into the pin insertion hole 21*a* such that the pin terminal 14*a* passes through the tubular contacts 22*c* of the connection portions 22*a* of successive wire terminals 14.

Figure 26:
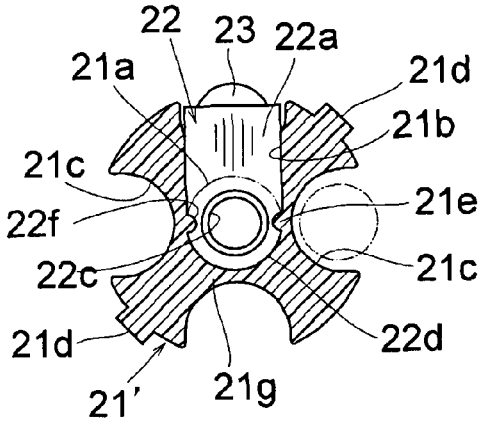
FIG. 26 is a lateral cross sectional view illustrating a condition in which the wire terminal is inserted into the holding body in another modified embodiment.

FIG. 26 is a cross sectional view showing another modified embodiment, in which a connection portion 22*a* of a wire terminal 22 has been inserted into a holding body 22'. Also in this modified embodiment, engaging projections 21*e* of the holding body 21' are engaged with engaging depressions 22*f* and the wire terminal 22 is positively held in position. Moreover, the holding body 21' has formed therein a front end engaging portion 21*g* which cooperates with a front end portion 22*d* of the connection portion 22*a*.

Figure 27:
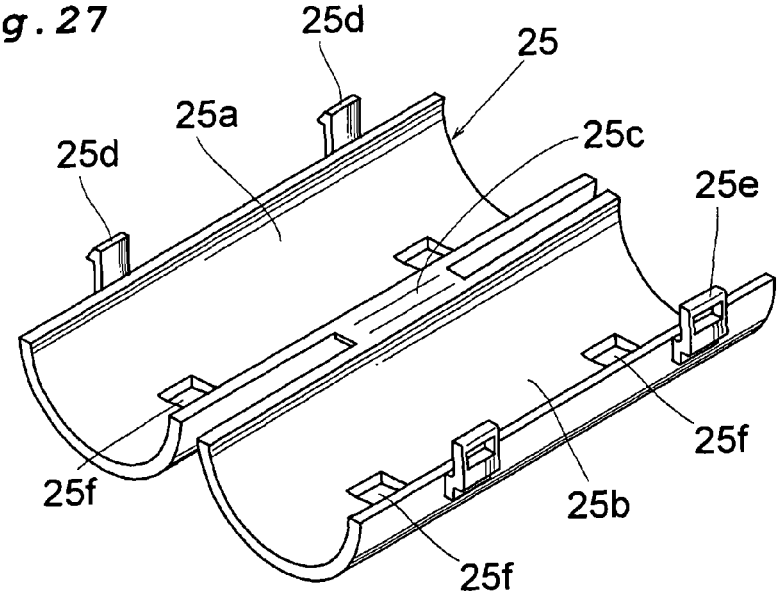
FIG. 27 is a perspective view of the protection cover.

FIG. 27 is a perspective view illustrating a protection cover 25 to be applied on the holding body 21'. The protection cover 25 formed into a tubular shape is made of a synthetic resin and includes two substantially semi-cylindrical halves 25*a* and 25*b* which are connected to each other by a hinge 25*c*, and locking members 25*d* and 25*e* are provided such that the two halves of the protection cover are coupled with each other. Furthermore, holes 25*f* are formed in the two halves 25*a* and 25*b*, in which the fitting projections 21*d* formed on the outer surface of the holding body 21' is engaged.

Figure 28:
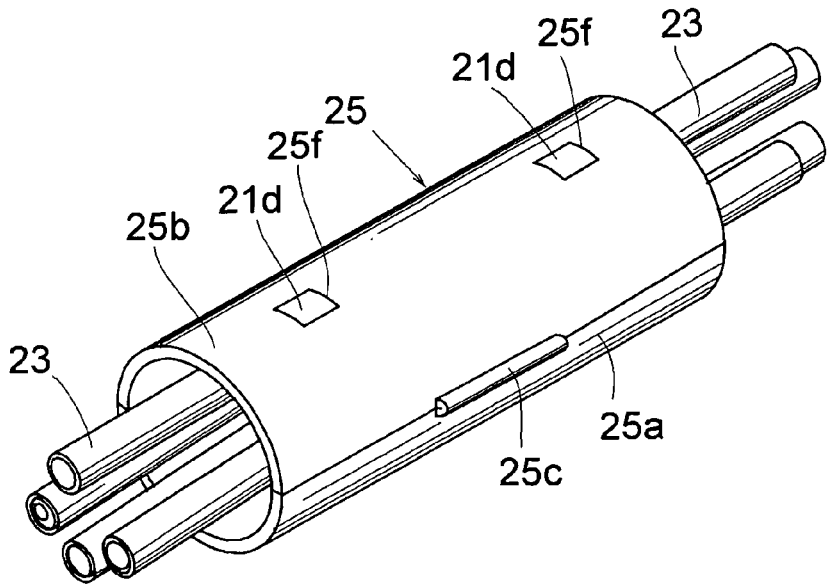
FIG. 28 is a perspective sectional view showing a condition in which the protection cover is applied to the harness connection body.

The protection cover 25 is positioned with respect to the harness connection body comprising the holding body 21', wire terminals 22 and through pin 14, while the fitting projections 21*d* of the holding body 21' are inserted into the holes 25*f* of the protection cover 25. The protection cover 25 is applied around the holding body 21' as depicted in FIG. 28. In this manner, the protection cover 25 can be prevented from being shifted with respect to the holding body 21' and the electrically insulating property is improved.

Embodiment 4

Figure 29:
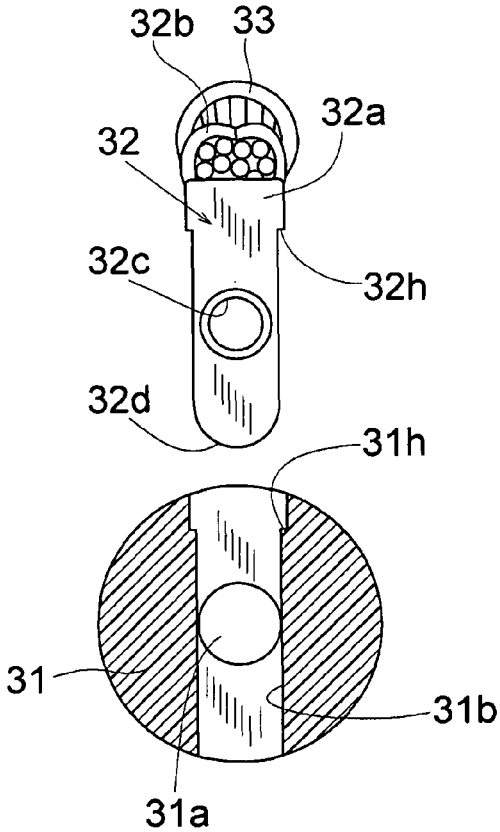
FIG. 29 is an explanatory view illustrating a combination of the holding body and wire terminal in the embodiment 4.

FIG. 29 is an explanatory figure showing a modified embodiment of a holding body 31 which is identical with the holding body of the embodiment 4 except for a point that the elongated grooves 21*c* are not formed. In the present embodiment 4, a connection portion 32*a* of a wire terminal 32 has formed therein engaging steps 32*h* at a portion near a root portion by thinning a wide of the connection portion 32*a*, and a wire terminal insertion hole 31*b* of the holding body 31 has formed corresponding engaging steps 31*h*. Therefore, the insertion of the connection portion 32*a* of the wire terminal 32 into the wire terminal insertion hole 31*b* of the holding body 31 is limited by these engaging steps and the connection portion 32*a* can be held at a given position.

Figure 30:
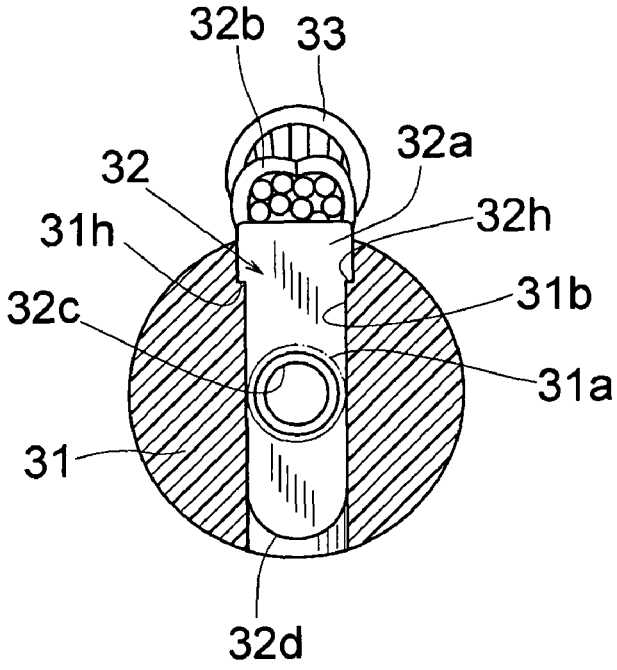
FIG. 30 is a lateral cross sectional view showing a condition in which the wire terminal is inserted into the holding body.
Figure 31:
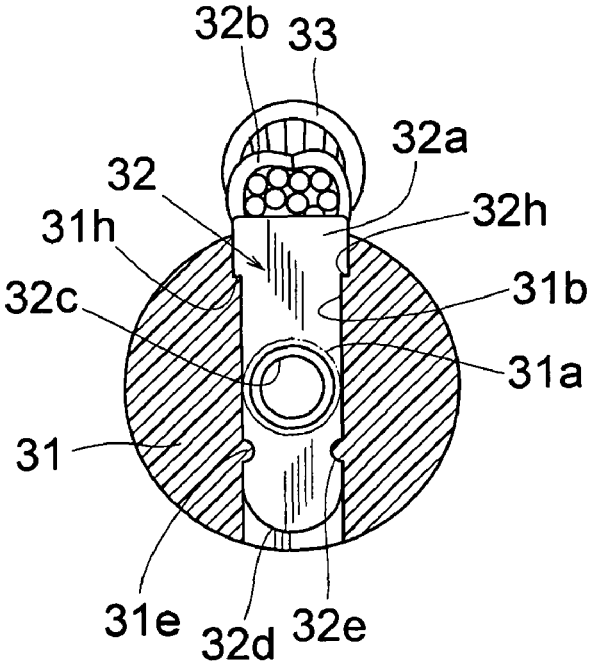
FIG. 31 is a lateral cross sectional view depicting a condition in which the wire terminal is inserted into a modified embodiment of the holding body.

FIG. 30 is a cross sectional view showing a modified embodiment, in which the connection portion 32*a* has formed therein engaging depressions 32*e* and the wire terminal insertion hole 31*b* has formed therein engaging depressions 31*e*. Therefore, the positioning of the connection portion 32*a* with respect to the wire terminal insertion hole 31*b* is further improved.

Embodiment 5

Figure 32:
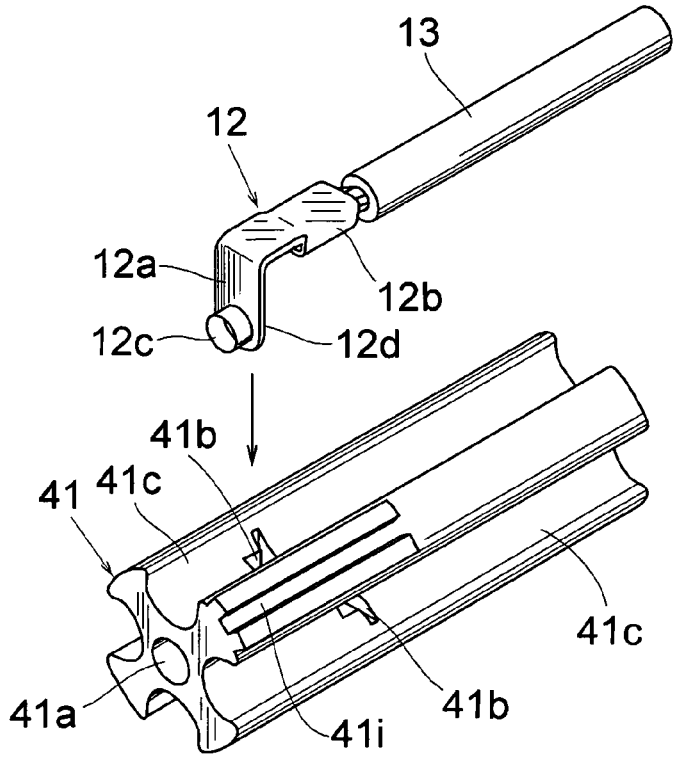
FIG. 32 is a perspective view representing a holding body of the embodiment 5.

In the present embodiment 5, as illustrated in FIG. 32, the harness connection body comprises a holding body 41 including a pin terminal insertion hole 41*a*, wire terminal insertion holes 41*b*, elongated grooves 41*c* and a positioning guide recess 41*i* for position, and a wire terminal 12 which is similar to the wire terminal 12 shown in FIG. 12.

The pin terminal insertion hole 41*a* is formed along a center axis of the holding body 41 such that the hole 41*a* is closed at the other end. In an outer surface of the holding body 41 there are formed four elongated grooves 41*c* extending in a longitudinal direction. Each of the wire terminal insertion hole 41*b* is formed in a bottom surface of each of the elongated grooves 41*c*. The positioning guide recess 41*i* is formed on the outer surface of the holding body 41 to extend in the axial direction. Said positioning guide recess 41*i* serves to guide the insertion of a protection case which will be explained later.

Figure 33:
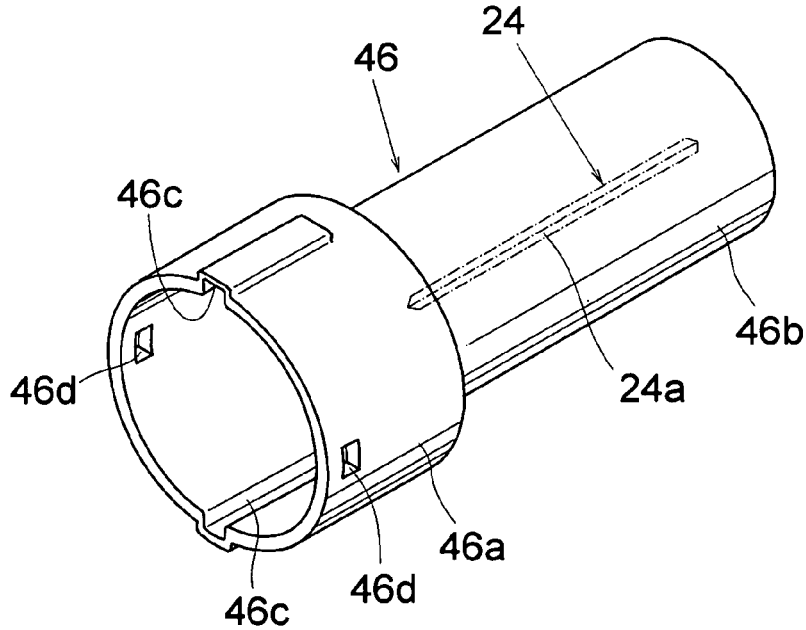
FIG. 33 is a perspective view showing a protection case.

FIG. 33 shows a cylindrical protection case 46 for accommodating the harness connection body, said protection case being made of a synthetic resin. The protection case 46 is consisting of a large diameter portion 46*a* having an inlet and a small diameter portion 46*b* whose remote end is closed. The large diameter portion 46*a* has formed therein guide recesses 46*c* and locking holes 46*d*. On an inner wall of the small diameter portion 46*b* there is formed a guide projection, not shown in the drawing, being fit into the positioning guide recess 41*i* of the holding body 41. On the center of the bottom of the protection case 46, there is provided a pin terminal 24*a* of a through pin 24 directing to the inlet, in which the through pin has a similar cross section to that shown in FIG. 7.

Figure 34:
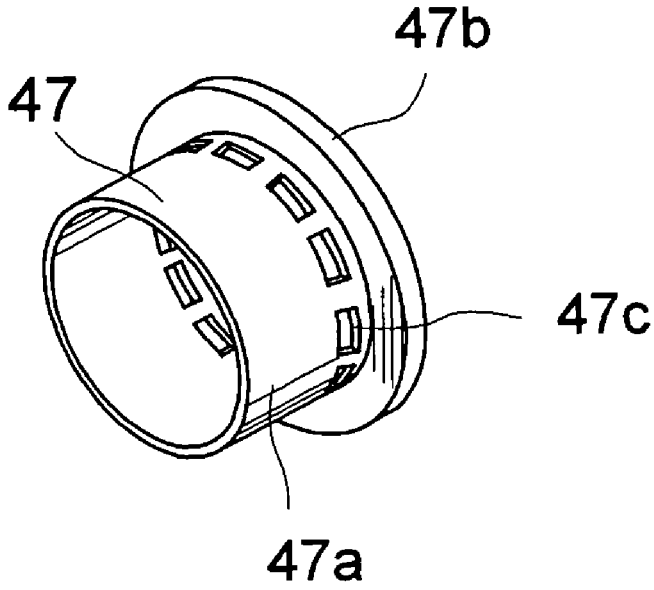
FIG. 34 is a perspective view of a liner.

Within the large diameter portion 46*a* of the protection case 46 is inserted a substantially cylindrical liner 47 shown in FIG. 34, said liner 7 being made of a synthetic resin. The liner 47 is consisting of a cylindrical portion 47*a* and a flange portion 47*b*, and a plurality slits 47*c* are formed in the cylindrical portion 47*a* at a root portion near the flange portion 47*b*.

Figure 35:
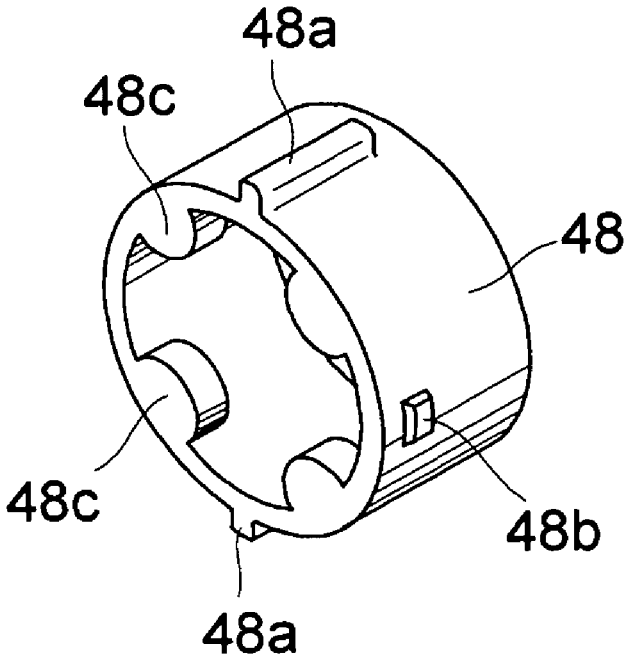
FIG. 35 is a perspective view of a cap.

Between the liner 47 and the large diameter portion 46*a* is inserted a substantially cylindrical cap 48 shown in FIG. 35, said cap 48 being also made of a synthetic resin. On an outer surface of the cap 48 there are formed guide ridges 48*a* which are fit into the guide recesses 46*c* of the protection case 46, and on an inner surface of the cap 48 there are formed locking protrusions 48*b* which are fit into the locking holes 46*d* of the protection case 46. On an inner surface of the cap 48 there are formed abutting protrusions 48*c*, against which the liner 47 is abutted.

Figure 36:
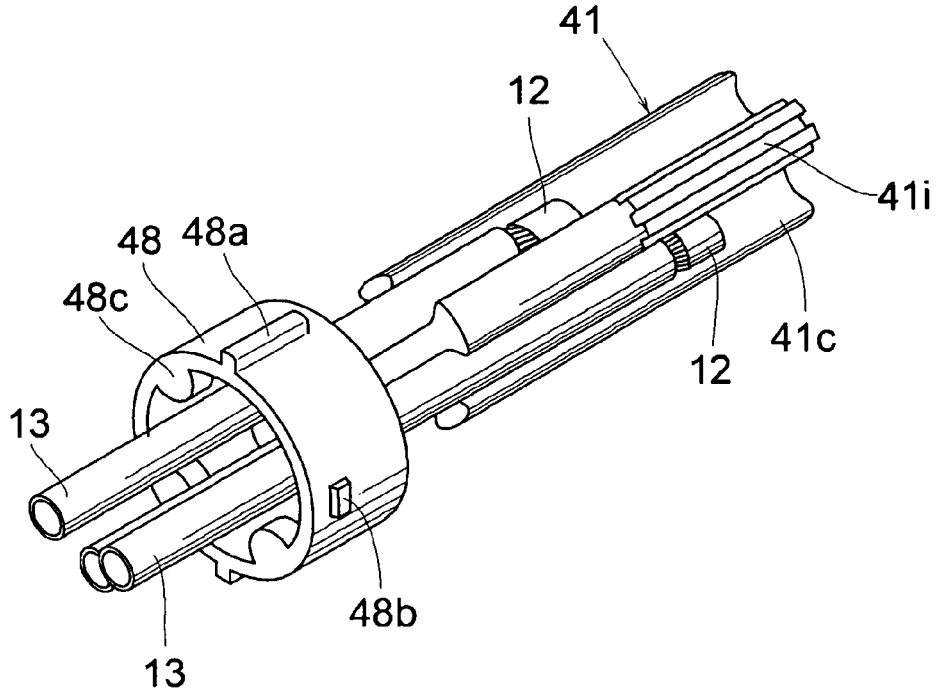
FIG. 36 is a perspective view showing the harness connection body and cap.

Upon assembling, the electric wires 13 have been previously passed through the cap 48, and then the connection portion 12*a* of the wire terminal 12 having the electric wire 13 connected thereto is inserted into the wire terminal insertion hole 41*b* of the holding body 41 as depicted in FIG. 36. In this case, the electric wire 13 is extended along the elongated groove 41*c*. It should be noted that the inserted connection portion 12*a* is held in position by means of engaging portions (not shown) formed in the wire terminal insertion hole 14*b*. Since the front end portion 12*d* of the connection portion 12*a* has a substantially identical radius with that of the pin terminal insertion hole 41*a*, the connection portion 12*a* is stably held within the pin terminal insertion hole 41*a* and a center axis of the tubular contact 12*c* is aligned with a center axis of the pin terminal insertion hole 41*a*.

Figure 37:
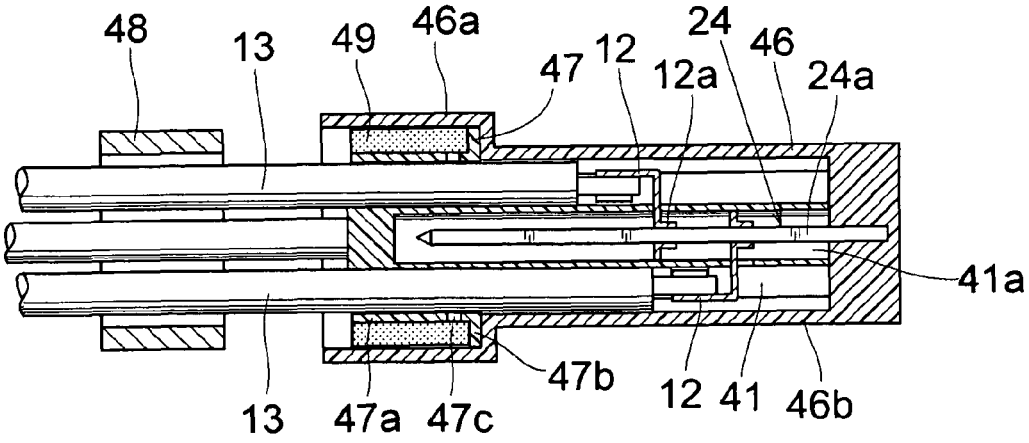
FIG. 37 is a longitudinal cross sectional view illustrating a condition in which the holding body is inserted into the protection case.

As illustrated in FIG. 37, after winding a gel-type butyl rubber 49 molded into a plate shape around the cylindrical portion 47*a* of the liner 47, the liner 47 is inserted into the large diameter portion 46*a* of the protection case 46. Then, the harness connection body is inserted into the protection case 46 while the pin terminal insertion hole 41*a* is faced forwardly. In this case, the guide projection formed on the inner surface of the small diameter portion 46*b* of the protection case 46 is fit into the positioning guide recess 41*i*.

During this insertion, the pin terminal 24*a* of the through pin 24 which is secured to the bottom of the protection case 46 passed through the tubular contacts 12*c* of the connection portions 12*a* of successive wire terminals 12 and all the connection portions 12*a* are short-circuited with each other and all the electric wires 13 are conductively connected to each other. The holding body 41 is fixed with respect to the protection case 46 by means of the guide projection and pin terminal 24*a* such that the holding body 41 could not be moved within the protection case 46.

It should be noted that the through pin 24 may be provided within the protection case 46, but prior to the insertion of the harness connection body into the protection case 46, the through pin 24 provided separately from the protection case 46 may be inserted into the pin terminal insertion hole 41*a* such that the wire terminals 12 are conductively connected to each other.

Figure 38:
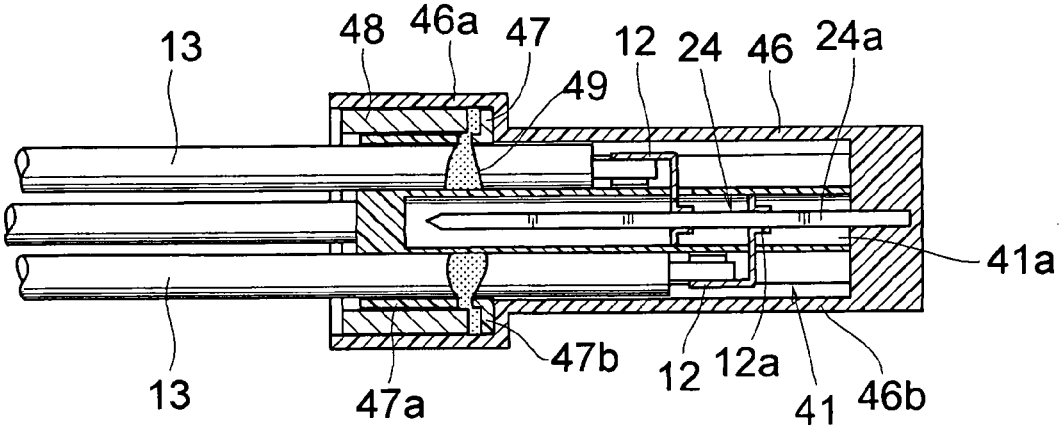
FIG. 38 is a longitudinal cross sectional view depicting a condition in which the cap is inserted into the protection case.

Next, as shown in FIG. 38, by moving forcedly the cap 48 on to the liner 47, the butyl rubber 49 is compressed to flow into the inner space of the liner 47 through the slits 47. Then, the butyl rubber 49 surrounds the electric wires 13 to perform waterproof. In this case, the waterproof can be attained regardless of diameters of the electric wires 13.

The insertion of the cap 48 is positively performed by the guide mechanism of the guide recess 46*c* of the protection cover 46 and guide ridge 48*a* of the cap 48. When the cap 48 is inserted into a given position, the locking projections 48*b* of the cap 48 are inserted into the locking holes 46*d* of the protection cover 46, and thus the cap 48 could not be accidentally removed from the protection cover 46.

In the connection member of the present embodiment 5, the waterproof structure can be attained with a reduced cost.

Embodiment 6

Figure 39:
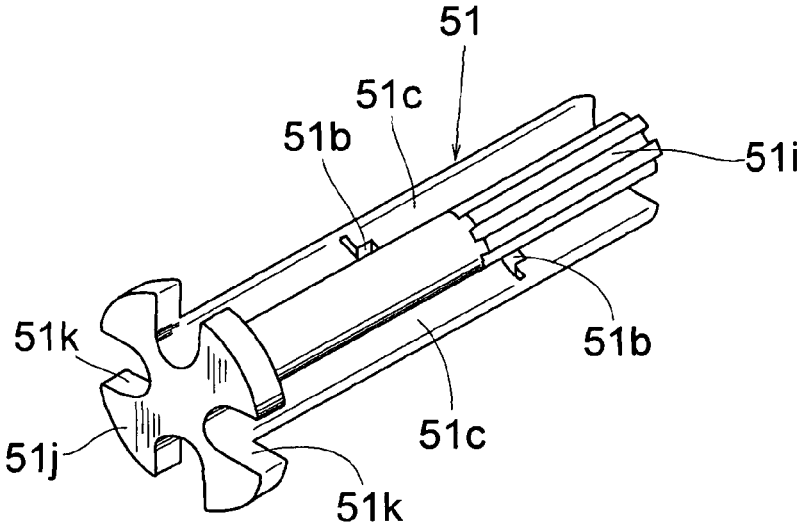
FIG. 39 is a perspective view showing a holding body of the embodiment 6.

FIG. 39 is a perspective view depicting a holding body 51 of the embodiment 6. Similarly to the holding body 41 of the embodiment 5, the holding body 51 has formed therein a pin terminal insertion hole 51*a* not shown, wire terminal insertion holes 51*b*, elongated grooves 51*c* and positioning guide recess 51*i*. A plate-like pushing portion 51*j* is further formed on an end portion of the holding body 51 remote from an inlet of the pin terminal insertion hole 51*a*, a circumferential diameter of said pushing portion 51*j* being identical with an inner diameter of the large diameter portion 56*a* of the protection case 56. In the pushing portion 51*j* there are formed four cut-out portions 51*k* each of which is communicated with respective one of the elongated grooves 51*c* such that the electric wires 13 connected to the wire terminals 12 are extended within the elongated grooves 51*c* and cut-out portions 51*k*.

Figure 40:
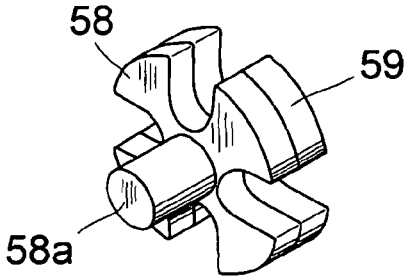
FIG. 40 is a perspective view depicting a cap.

FIG. 40 shows a waterproof cap 58 which is to be inserted into the protection case 56 accommodating the harness connection body. The cap 58 has a substantially identical shape of the pushing portion 51*j*, and a grip projection 58*a* is provided on a front surface and a gel-type butyl rubber 59 is applied on a rear surface.

Figure 41:
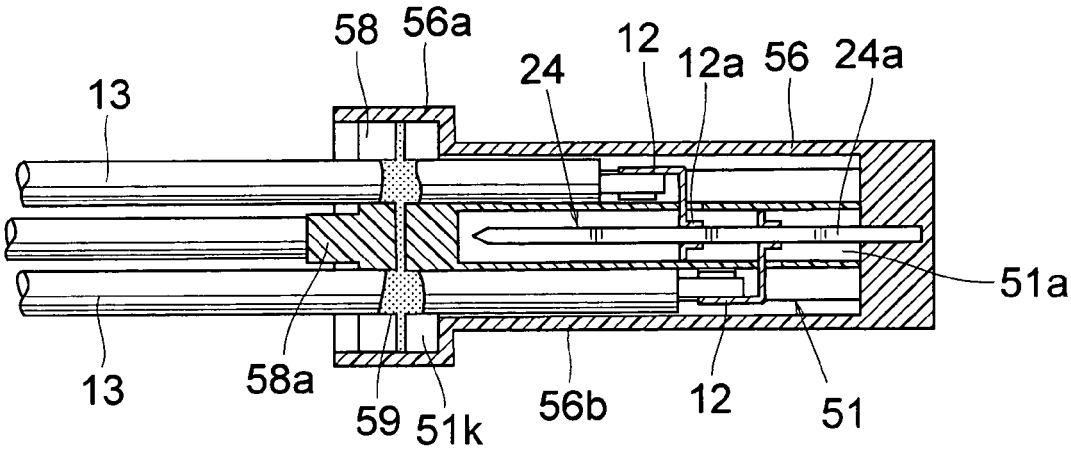
FIG. 41 is a longitudinal cross sectional view sowing a condition in which the cap is inserted into the protection case.

In the present embodiment 6, after accommodating the harness connection body assembled by the holding body 51 and wire terminals 12 within the protection case 56 like the embodiment 5, the cap 58 is forcedly inserted into the large diameter portion 56*a* of the protection case 56 as shown in FIG. 41. By this insertion, the butyl rubber 59 applied on the rear surface of the cap 58 is compressed and is flown into a space surrounding the electric wires 13 to form the waterproof structure.

What is claimed is:

1. A connection member comprising:

a plurality of wire terminals;

a pillar-shaped holding body having: (i) a pin terminal insertion hole extending in an axial direction of the holding body, (ii) one or more elongated grooves formed on an outer surface of the holding body for accommodating electric wires, and (iii) a plurality of wire terminal insertion holes formed on bottoms of said one or more elongated grooves, wherein said plurality of wire terminal insertion holes are adapted to be inserted with said plurality of wire terminals which are adapted to be connected to said electric wires; and a pin terminal adapted to be inserted into said pin terminal insertion hole such that the pin terminal is brought into contact with said plurality of wire terminals to conductively connect said wire terminals to each other.

2. The connection member according to claim 1, wherein each of said one or more elongated grooves has a substantially semi-circular cross section.

3. The connection member according to claim 1, wherein said pin terminal has a substantially rectangular cross section.

4. The connection member according to claim 3, wherein a front end of said pin terminal is shaped into a cone or frustcone.

5. The connection member according to claim 1, wherein a front end of said pin terminal is shaped into a cone or frustcone.

* * * * *